US005241934A

United States Patent [19]

Laimböck

[11] Patent Number: 5,241,934

[45] Date of Patent: Sep. 7, 1993

[54] LIQUID-COOLED INTERNAL COMBUSTION ENGINE

[76] Inventor: Franz Laimböck, Waldsdorfberg 86, A-8051 Graz-Thal, Austria

[21] Appl. No.: 698,459

[22] Filed: May 10, 1991

[30] Foreign Application Priority Data

May 16, 1990 [AT] Austria ..... 1086/90

[51] Int. Cl.[5] ..... F02B 77/00

[52] U.S. Cl. ..... 123/198 E; 123/195 C

[58] Field of Search ..... 123/195 C, 196 R, 198 E, 123/2

[56] References Cited

U.S. PATENT DOCUMENTS 4,480,608 11/1984 Valev ..... 123/198 E
4,667,628 5/1987 Lopez-Crevillen ..... 123/198 E
4,709,670 12/1987 Ampferer ..... 123/198 E

FOREIGN PATENT DOCUMENTS 121814 3/1931 Austria .

*Primary Examiner*—Noah P. Kamen
*Attorney, Agent, or Firm*—Collard, Roe & Galgano

[57] ABSTRACT

A liquid-cooled internal combustion engine having a piston-controlled exhaust, particularly a two-stroke cycle internal combustion engine, is provided with a generator or a magneto-generator unit and with a lubricating oil pump. The cylinder head is provided with a cap, which defines a space for cooling liquid and extends over the cylinder approximately as far as to the exhaust port and at its end that is adjacent to the crankshaft has a sealing surface. In order to minimize the transmission of solid-borne sound and the radiation of sound, the cap and the cover for the oil pump are secured by means of collar screws, which have been tightened against a stop, and a washer provided with a vulcanization-bonded rubber layer is disposed between the head of each of said screws and the cap or the cover.

5 Claims, 3 Drawing Sheets

LIQUID-COOLED INTERNAL COMBUSTION ENGINE

BACKGROUND OF THE INVENTION

1. Field of the Invention

This invention relates to a liquid-cooled internal combustion engine comprising a cylinder having an axis extending between opposite ends of the cylinder, a cylinder head closing one of the cylinder ends, the cylinder being in communication with an exhaust passage axially spaced from the cylinder head, a crankshaft extending transversely to the cylinder axis and spaced from the end of the cylinder opposite the one cylinder end, a metallic housing means wherein the crankshaft is rotatably mounted, a metallic cap mounted over the cylinder head and cylinder, the metallic cap, the cylinder head and the cylinder defining a chamber for a cooling liquid, and the metallic cap having a sealing surface remote from the cylinder head and facing the metallic housing means, a piston slidably mounted in the cylinder and operatively connected to the crankshaft, the piston being operable to open and close communication between the cylinder and the exhaust passage, electric power generating means operatively connected to the crankshaft, and a lubricating oil pump operatively connected to the crankshaft and operable to discharge lubricating oil.

2. Description of the Prior Art

Such internal combustion engines are known, for example, from Austrian patent No. 121,814. According to this patent, a yieldable seal is provided between the cylinder head and the cap but there are no means for preventing the transmission of sound emanating from the area where the sealing surface of the metallic cap contacts the metallic housing means facing the sealing surface. Besides, the cap is screw-connected to the engine housing or crankcase without the interposition of sound insulating means. Therefore, the screws as well as the hard seals will transmit sound from the cylinder to the cap so that the cap will radiate corresponding sound waves. If the electric power generating means is mounted directly under the lubricating oil pump, no means is provided for preventing sound transmission from that area of the engine.

SUMMARY OF THE INVENTION

It is an object of the invention to eliminate these disadvantages, to minimize vibrations occurring within the frequency spectrum of internal combustion engines during their operation, and to inhibit the transmission of sound between the metallic parts of the engine secured to each other.

This object is accomplished according to the present invention by arranging a first metallic cover over the lubricating oil pump and a second metallic cover over the electric power generating means, the first and second metallic covers having sealing surfaces facing the housing means. The first and second metallic covers are secured to the metallic housing means at the sealing surfaces, and soft, non-metallic seals are interposed between the sealing surfaces and the metallic housing means, the seals preventing metal-to-metal contact between the sealing surfaces and the housing means.

As a result, the metallic cap and the two metallic covers are acoustically decoupled from the metallic housing means, i.e. the crankcase, so that no sound will be transmitted therebetween and there will be no radiation of sound from any structural parts enclosed by the covers.

According to one feature of this invention, the metallic housing means has a surface facing the sealing surface of the metallic cap, tapped bores extending into the metallic housing means from the surface thereof, and metallic collar screws firmly secure the metallic cap to the metallic housing means. Each collar screw has a collar part, a screw part and a head part for securing the metallic cap to the metallic housing means, the head part engaging the metallic cap, the collar part extending from the head part through the metallic cap and engaging the metallic housing means surface around a respective tapped bore, and the screw part extending into the tapped bore. To avoid metal-to-metal contact, a washer including a vulcanization-bonded rubber layer surrounds the collar part and is interposed between the head part and the cap.

Because collar screws are used to secure the cap to the housing means, they can be tightened against the housing means surface only to a certain extent so that excessive compression of the soft seals is avoided. Nevertheless, there will be no metal-to-metal contact because the washer includes a rubber layer disposed between the head part of the screw and the cap. The hardness of the rubber must be so selected that the sealing function of the washer is assured.

The covers may be secured to the housing means by like collar screws.

According to previous practice, the lubricating oil pump has usually been movably mounted in the associated cover. Since the pump is driven by the crankshaft through interposed gears, constant distances between their axes are required while the pump cover will perform small movements relative to the crankcase when they are secured to each other by soft seals. Accordingly, the liquid-cooled internal combustion engine further comprises carrier arms projecting from the crankcase, a metallic carrier rigidly secured to the carrier arms, the lubricating oil pump being movably mounted on the metallic carrier in an opening of the first metallic cover, a closure detachably mounted on the first metallic cover for closing the opening, the first metallic cover having a further sealing surface facing the metallic carrier, and a non-metallic soft seal interposed between the further sealing surface and the metallic carrier for preventing metal-to-metal contact between the further sealing surface and the metallic carrier. Because the lubricating oil pump is mounted on the carrier, the distance from the crankshaft to the gear drive is exactly fixed. Nevertheless, the transmission of sound to the pump cover is interrupted while, at the same time, the detachable closure permits access to the opening which holds the pump.

According to a particularly desirable feature, the housing means comprises a cylindrical part accommodating the electric power generating means, the second metallic cover terminates in a tubular skirt extending into the cylindrical housing means part, and further comprising O-ring means fitted between the cylindrical housing means part and the tubular skirt, the O-ring means securing the cylindrical housing means part and the tubular skirt to each other. This embodiment combines a first fit, a satisfactory acoustic decoupling and low manufacturing costs.

DETAILED DESCRIPTION OF PREFERRED EMBODIMENT

Figure 1:
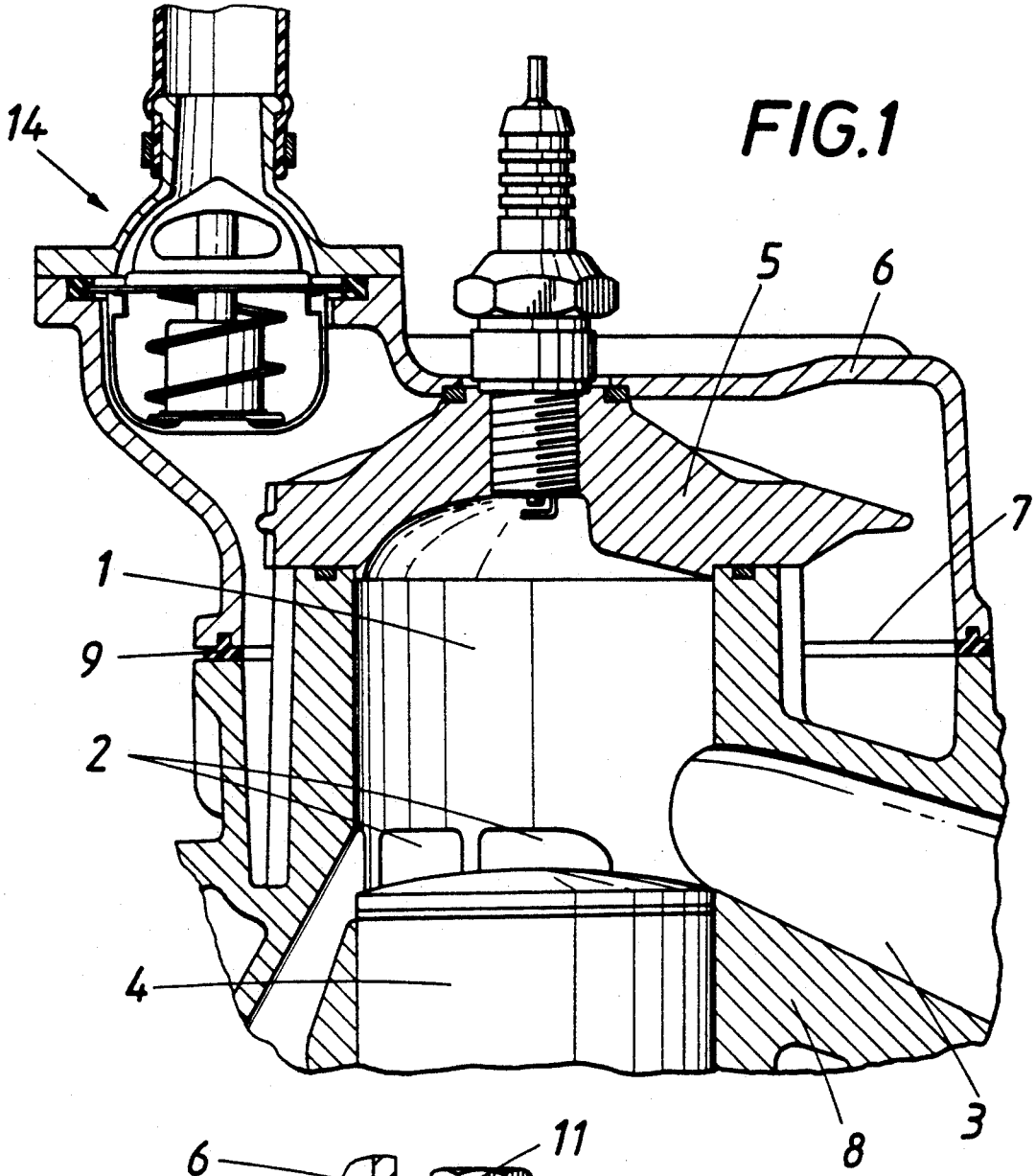
FIG. 1 is a fragmentary sectional view along the cylinder axis and shows the top portion of a liquid-cooled internal combustion engine according to this invention.

The drawing shows a two-stroke, liquid-cooled internal combustion engine. The engine comprises cylinder 1 having an axis extending between opposite ends of the cylinder and cylinder head 5 closing one of the cylinder ends, the cylinder having transfer ports 2 for a fuel-air mixture and an exhaust port being in communication with exhaust passage 3 axially spaced from the cylinder head. Opening and closing of the cylinder ports are controlled by piston 4 slidably mounted in the cylinder and operatively connected to crankshaft 22, the piston being operable to open and close communication between the cylinder and the exhaust passage. Crankshaft 22 extends transversely to the cylinder axis and is spaced from the end of the cylinder opposite the one cylinder end closed by cylinder head 5. The crankshaft is rotatably mounted in a metallic housing means illustrated as crankcase 8. Metallic cap 6 is mounted over cylinder head 5 and cylinder 1 the metallic cap, the cylinder head and the cylinder defining a chamber for a cooling liquid. The metallic cap extends over the cylinder approximately as far as exhaust passage 3 and has sealing surface 7 remote from cylinder head 5 and facing crankcase 8.

Figure 3:
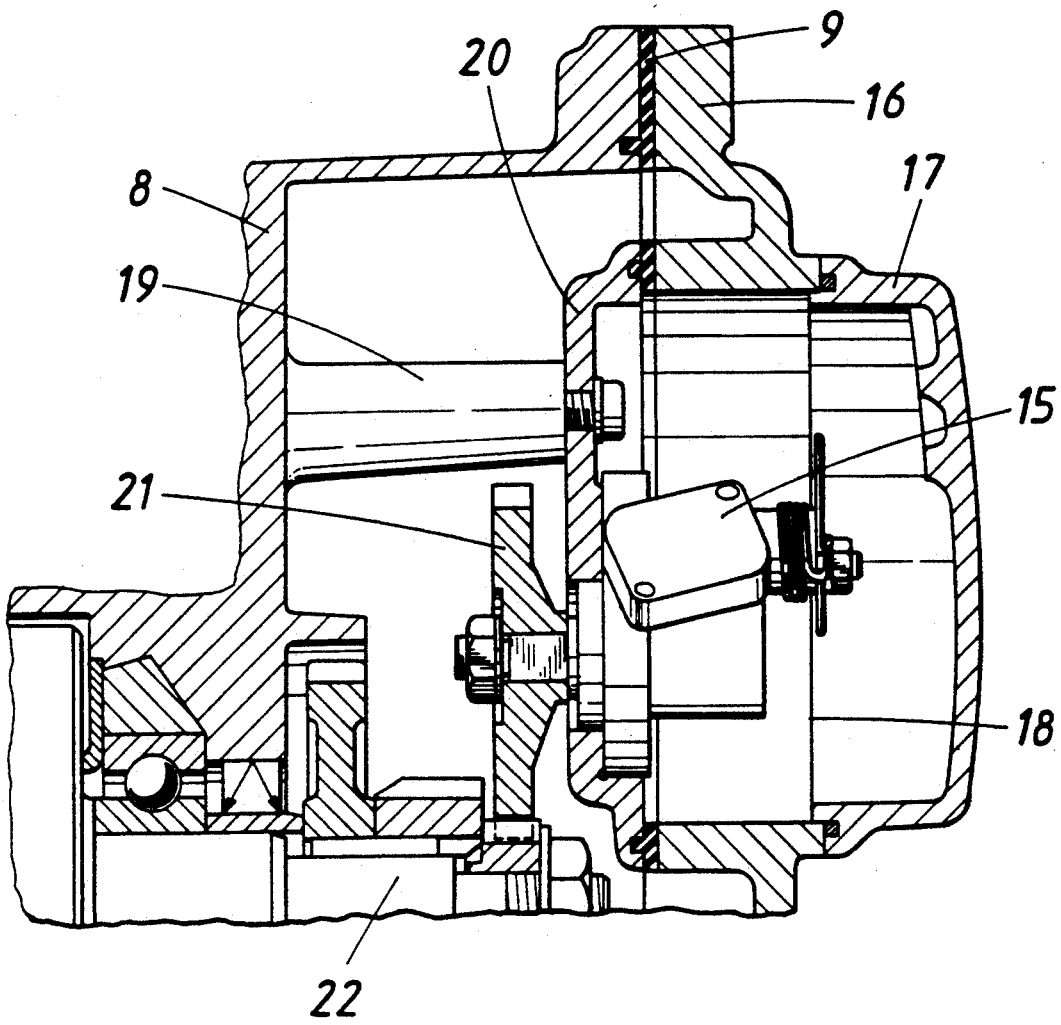
FIG. 3 is an enlarged fragmentary view along the axis of the crankshaft and shows the mounting of the lubricating oil pump.
Figure 4:
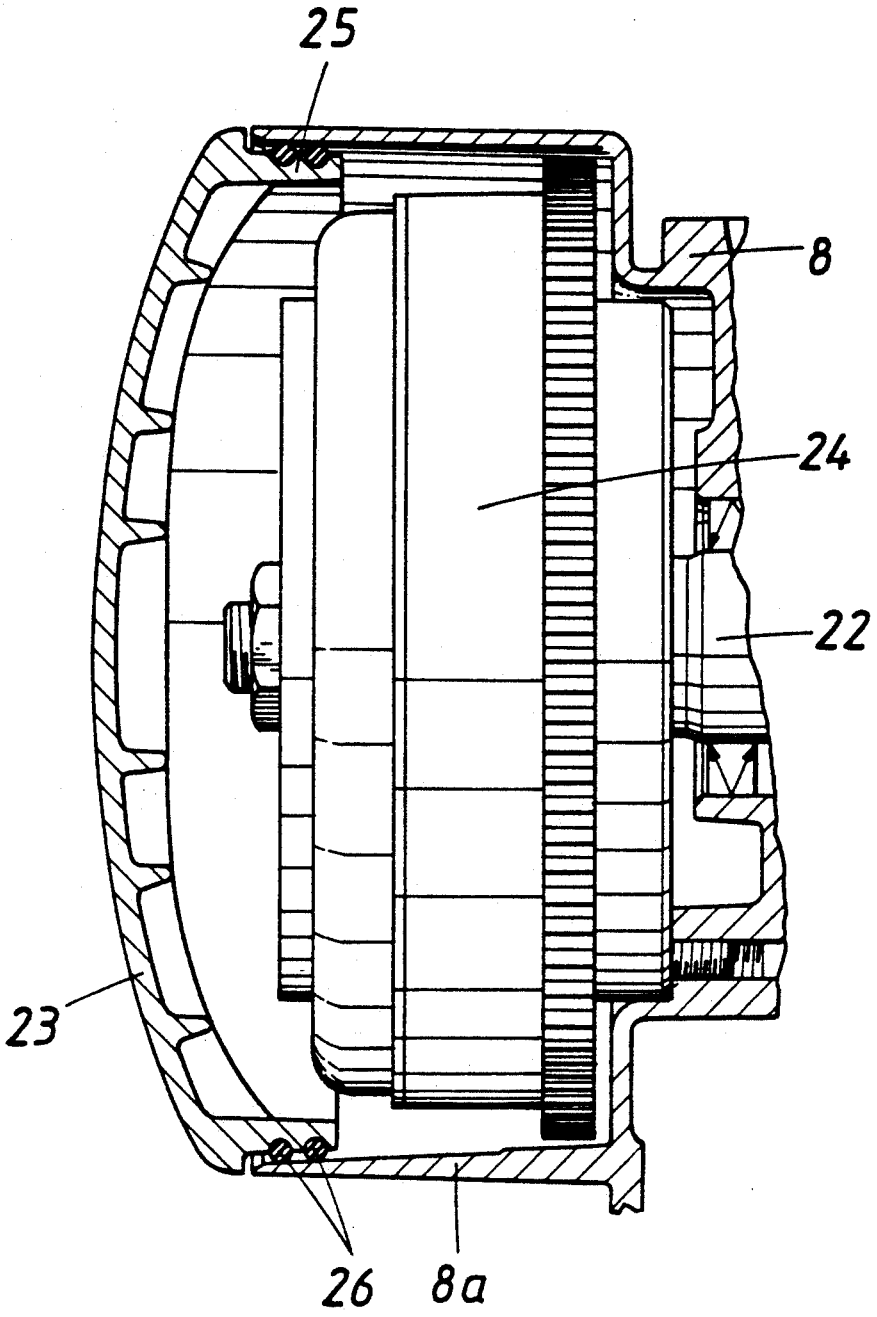
FIG. 4 is a side elevational view, partly in section, and shows the electric power generating means and the cover therefor.

As shown in FIG. 4, the engine further comprises electric power generating means 24, which may be a generator unit, as well as lubricating oil pump 15 operatively connected to crankshaft 22 and operable to discharge lubricating oil (see FIG. 3).

According to the invention, first metallic cover 16 is arranged over lubricating oil pump 15 and second metallic cover 23 is arranged over electric power generating means 24, i.e. an electric generator or magneto-generator unit. The first and second metallic covers have sealing surfaces facing the crankcase 8, metallic cap 6 and first and second metallic covers 16, 23 being secured to the metallic crankcase at the sealing surfaces. Soft, non-metallic seals 9 are interposed between the sealing surfaces and the crankcase 8, the seals preventing metal-to-metal contact between the sealing surfaces and the crankcase.

Thermostat 14 is indicated in FIG. 1 and extends into the cooling liquid chamber.

As shown in FIG. 3, carrier arms 19 project from crankcase 8 and metallic carrier 20 is rigidly secured to the carrier arms. Lubricating oil pump 15 is not secured to cover 16 but is movably mounted on metallic carrier 20 in opening 18 of first metallic cover 16. Closure 17 is detachably mounted on the first metallic cover for closing the opening, the first metallic cover having a further sealing surface facing metallic carrier 20. A non-metallic soft seal is interposed between the further sealing surface and metallic carrier 20 for preventing metal-to-metal contact between the further sealing surface and the metallic carrier. Gear 21 operatively connects lubricating oil pump 15 to crankshaft 22. In this mounting of the oil pump, the distance between gear 21 and crankshaft 22 remains constant.

Figure 2:
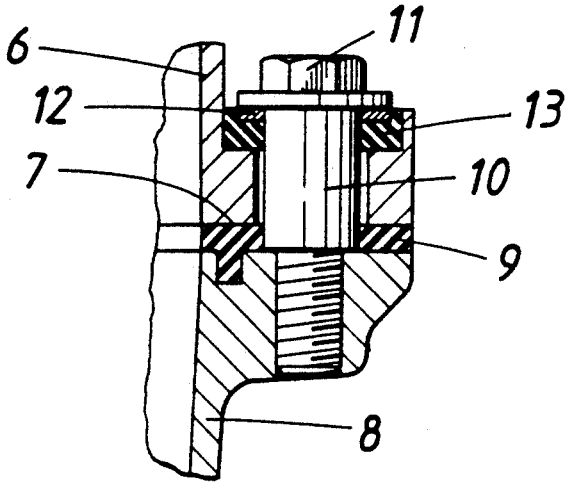
FIG. 2 is an enlarged fragmentary view showing a structural detail.

As shown in FIG. 2, crankcase 8 has a surface facing the sealing surface of metallic cap, tapped bores extending into the metallic crankcase from the surface thereof. Metallic collar screws 10 each having a collar part, a screw part and a head part 11 secures metallic cap 6 to crankcase 8, head part 11 engaging metallic cap 6, the collar part extending from the head part through the metallic cap and engaging the metallic crankcase surface around a respective tapped bore, and the screw part extending into the respective tapped bore. Washer 12 including vulcanization-bonded rubber layer 13 surrounds the collar part and is interposed between head part 11 and cap 6. The collar screws are tightened until their collar parts abut the surface of crankcase 8, rubber layer 13 preventing any metal-to-metal contact between cap 6, crankcase 8 and screw 10. The covers may be secured to the crankcase in a like manner.

In the embodiment illustrated in FIG. 4, crankcase 8 comprises cylindrical part **8*a* accommodating electric power generating means 24 and second metallic cover 23 terminates in tubular skirt 25 extending into cylindrical part 8*a*. O-rings 26 are fitted between cylindrical part 8*a* and tubular skirt 25, the O-rings securing the cylindrical part 8*a* and tubular skirt 25** to each other.

I claim:

1. A liquid-cooled internal combustion engine comprising (a) a cylinder having an axis extending between opposite ends of the cylinder, (b) a cylinder head closing one of the cylinder ends, the cylinder being in communication with an exhaust passage axially spaced from the cylinder head, (c) a crankshaft extending transversely to the cylinder axis and spaced from the end of the cylinder opposite the one cylinder end, (d) a metallic housing means wherein the crankshaft is rotatably mounted, (e) a metallic cap mounted over the cylinder head and cylinder, (1) the metallic cap, the cylinder head and the cylinder defining a chamber for a cooling liquid, and (2) the metallic cap having a sealing surface remote from the cylinder head and facing the metallic housing means, (f) a piston slidably mounted in the cylinder and operatively connected to the crankshaft, the piston being operable to open and close communication between the cylinder and the exhaust passage, (g) electric power generating means operatively connected to the crankshaft, (h) a lubricating oil pump operatively connected to the crankshaft and operable to discharge lubricating oil, (i) a first metallic cover arranged over the lubricating oil pump and a second metallic cover arranged over the electric power generating means, the first and second metallic covers having sealing surfaces facing the housing means, (1) the metallic cap and the first and second metallic covers being secured to the metallic housing means at the sealing surfaces, and (j) soft, non-metallic seals interposed between the sealing surfaces and the metallic housing means, the seals preventing metal-to-metal contact between the sealing surfaces and the housing means.

2. The liquid-cooled internal combustion engine of claim 1, wherein the housing means is a crankcase.

3. The liquid-cooled internal combustion engine of claim 2, further comprising carrier arms projecting from the crankcase, a metallic carrier rigidly secured to the carrier arms, the lubricating oil pump being movably mounted on the metallic carrier in an opening of the first metallic cover, a closure detachably mounted on the first metallic cover for closing the opening, the first metallic cover having a further sealing surface facing the metallic carrier, a non-metallic soft seal interposed between the further sealing surface and the metallic carrier for preventing metal-to-metal contact between the further sealing surface and the metallic carrier, and gear means operatively connecting the lubricating oil pump to the crankshaft.

4. The liquid-cooled internal combustion engine of claim 1, wherein the metallic housing means has a surface facing the sealing surface of the metallic cap, tapped bores extending into the metallic housing means from the surface thereof, and further comprising metallic collar screws each having a collar part, a screw part and a head part for securing the metallic cap to the metallic housing means, the head part engaging the metallic cap, the collar part extending from the head part through the metallic cap and engaging the metallic housing means surface around a respective one of the tapped bores, and the screw part extending into the respective tapped bore, and a washer including a vulcanization-bonded rubber layer, the washer surrounding the collar part and being interposed between the head part and the cap.

5. The liquid-cooled internal combustion engine of claim 1, wherein the housing means comprises a cylindrical part accommodating the electric power generating means, the second metallic cover terminates in a tubular skirt extending into the cylindrical housing means part, and further comprising O-ring means fitted between the cylindrical housing means part and the tubular skirt, the O-ring means securing the cylindrical housing means part and the tubular skirt to each other.

* * * * *